US009085171B2

(12) United States Patent
Liu et al.

(10) Patent No.: US 9,085,171 B2
(45) Date of Patent: Jul. 21, 2015

(54) INK JET PRINTING CONTROL METHOD AND DEVICE

(71) Applicants: PEKING UNIVERSITY FOUNDER GROUP CO., LTD., Beijing (CN); BEIJING FOUNDER ELECTRONICS CO., LTD., Beijing (CN)

(72) Inventors: Xiaowei Liu, Beijing (CN); Zhenhua Li, Beijing (CN)

(73) Assignees: PEKING UNIVERSITY FOUNDER GROUP CO., LTD., Beijing (CN); BEIJING FOUNDER ELECTRONICS CO., LTD., Beijing (CN)

( * ) Notice: Subject to any disclaimer, the term of this patent is extended or adjusted under 35 U.S.C. 154(b) by 0 days.

(21) Appl. No.: 14/123,709

(22) PCT Filed: Dec. 21, 2012

(86) PCT No.: PCT/CN2012/087168
§ 371 (c)(1),
(2) Date: Dec. 3, 2013

(87) PCT Pub. No.: WO2013/091572
PCT Pub. Date: Jun. 27, 2013

(65) Prior Publication Data

US 2014/0292875 A1 Oct. 2, 2014

(30) Foreign Application Priority Data

Dec. 21, 2011 (CN) ..... 2011 1 0435754

(51) Int. Cl.
*B41J 29/38* (2006.01)
*B41J 13/00* (2006.01)
*B41J 11/46* (2006.01)

(52) U.S. Cl.
CPC ..... *B41J 13/0009* (2013.01); *B41J 11/46* (2013.01)

(58) Field of Classification Search
CPC ..... B41J 11/42; B41J 29/393; B41J 29/38; B41J 3/60; B41J 11/0095
USPC ..... 347/16, 104
See application file for complete search history.

(56) References Cited

U.S. PATENT DOCUMENTS

| | | | | | |
|---|---|---|---|---|---|
| 5,461,468 | A * | 10/1995 | Dempsey et al. | 399/396 |
| 5,848,784 | A * | 12/1998 | Tranquilla | 271/10.03 |
| 6,142,620 | A * | 11/2000 | Sagi | 347/101 |
| 6,158,344 | A | 12/2000 | Walker et al. | |
| 2007/0103497 | A1 * | 5/2007 | Takamura | 347/12 |
| 2008/0166165 | A1 * | 7/2008 | Mohri | 399/397 |
| 2009/0003848 | A1 * | 1/2009 | Jo et al. | 399/16 |
| 2010/0138432 | A1 * | 6/2010 | Noyes | 707/758 |

FOREIGN PATENT DOCUMENTS

| | | | |
|---|---|---|---|
| CN | 1699064 | A | 11/2005 |
| CN | 1807106 | A | 7/2006 |
| CN | 101786385 | A | 7/2010 |
| CN | 101844463 | A | 9/2010 |
| CN | 102189771 | A | 9/2011 |

OTHER PUBLICATIONS

International Search Report dated Mar. 28, 2013 from International Patent Application No. PCT/CN2012/087168 filed Dec. 21, 2012.

* cited by examiner

*Primary Examiner* — Manish S Shah
*Assistant Examiner* — Yaovi Ameh
(74) *Attorney, Agent, or Firm* — Workman Nydegger

(57) ABSTRACT

An ink jet printing control method and device, the method comprising: judging whether the interval distance between a detected current color code on a print stock and the previous color code of the current color code is smaller than a time delay distance; if yes, then recording the interval distance, and printing the content corresponding to the current color code after the print stock has moved for a period of time required for the interval distance from the time when the content corresponding to the previous color code is completely printed. With the solution of the present invention, within the time when the device is waiting for the previous color code of the print stock to move for the time delay distance, recording the interval distance between the current color code and the previous color code after the current color code is detected, and printing the content corresponding to the current color code after the content corresponding to the previous color code is completely printed and the print stock has moved for the interval distance, thus avoiding the occurrence of defective prints because the current color code is not processed.

7 Claims, 4 Drawing Sheets

INK JET PRINTING CONTROL METHOD AND DEVICE

The present application is a US National Stage of International Application No. PCT/CN2012/087168, filed 21 Dec. 2012, designating the United States, and claiming priority to Chinese patent application No. 201110435754.6, filed with the Chinese Patent Office on Dec. 21, 2011 and entitled "Method and apparatus for controlling ink-jet printing", both of which are incorporated herein by reference in their entirety.

FIELD OF THE INVENTION

The present invention relates to the field of printing and particularly to a method and apparatus for controlling ink-jet printing.

BACKGROUND OF THE INVENTION

Digital ink-jet printing is a printing technology rapidly developed in recent years, where data is processed and then ink is jetted for the purpose of printing.

Referring to FIG. 1, which is a schematic diagram of an ink-jet printing device in operation, where a print carrier 105 is driven by driving shafts 101 and 106 to move from left to right. Particularly the distance between the location where a color label sensor 102 is located and the location where a jet head 103 is located is referred to as a delay distance.

Starting from detection of a color label by the color label sensor 102 until the print carrier 105 moves over the delay distance, ink drops 104 are jetted from jet head 103 to form an image on the print carrier 105.

In the printing process, the distance between two color labels may be below the delay distance, in this case, when the color label sensor 102 detects the second one of the two color labels on the print carrier 105, the device is waiting for the first one of these two color labels to move over the delay distance without processing the detected second color label, thus resulting in an inferior print.

SUMMARY OF THE INVENTION

The invention is intended to provide a method and apparatus for controlling ink-jet printing so as to address the problem of an inferior print.

In an embodiment of the invention, there is provided a method for controlling ink-jet printing, the method includes: determining whether a separation distance between a current color label detected on a print carrier and a preceding color label of the current color label is below a delay distance; recording the separation distance if it is below the delay distance; and printing contents corresponding to the current color label when the print carrier moves over the separation distance starting from the end of printing contents corresponding to the preceding color label.

In an embodiment of the invention, there is provided an apparatus for controlling ink-jet printing, the apparatus includes: a determining module configured to determine whether a separation distance between a current color label detected on a print carrier and a preceding color label of the current color label is below a delay distance; a first storing module configured to record the separation distance and trigger a first printing module when a result of determination by the determining module is being below the delay distance; and the first printing module configured to print contents corresponding to the current color label when the print carrier moves over the separation distance starting from the end of printing contents corresponding to the preceding color label.

With the foregoing steps, a device waiting for the preceding color label on the print carrier to move over the delay distance detects the current color label and then records the separation distance between the two color labels and prints the contents corresponding to the current color label after printing of the contents corresponding to the preceding color label is finished and the print carrier further moves over the separation distance, thereby avoiding an inferior print from being produced because the current color label has not been processed.

BRIEF DESCRIPTION OF THE DRAWINGS

The drawings are described below to provide further understanding of the invention and constitute a part of the specification, and exemplary embodiments of the invention and their description serve to explain the invention but will not limit the invention unduly. In the drawings.

DETAILED DESCRIPTION OF THE EMBODIMENTS

Figure 2:
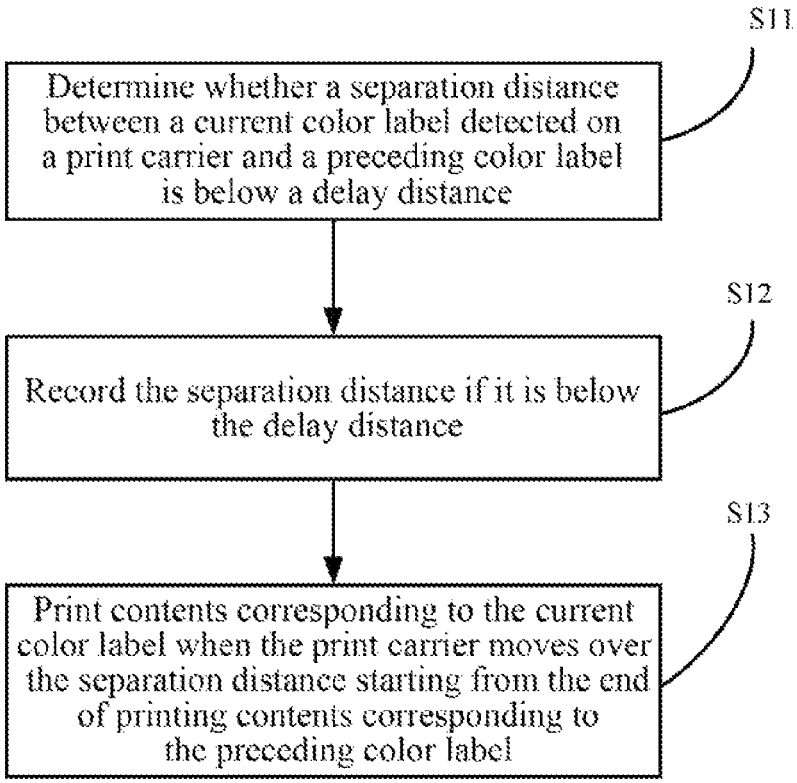
FIG. 2 illustrates a flow chart of a method for controlling ink-jet printing according to an embodiment of the invention.

The invention will be described below in details with reference to the drawings and embodiments thereof. Referring to FIG. 2, which is a flow chart of a method for controlling ink-jet printing according to an embodiment of the invention, the method includes the following steps.

S11 is to determine whether a separation distance between a current color label detected on a print carrier and a preceding color label of the current color label is below a delay distance.

S12 is to record the separation distance if it is below the delay distance.

S13 is to print contents corresponding to the current color label when the print carrier moves over the separation distance starting from the end of printing contents corresponding to the preceding color label.

With the foregoing steps, a device waiting for the preceding color label on the print carrier to move over the delay distance detects the current color label and then records the separation distance between the two color labels and prints the contents corresponding to the current color label after printing of the contents corresponding to the preceding color label is finished and the print carrier further moves over the separation distance, thereby avoiding an inferior print from being produced because the current color label has not been processed.

Figure 3:
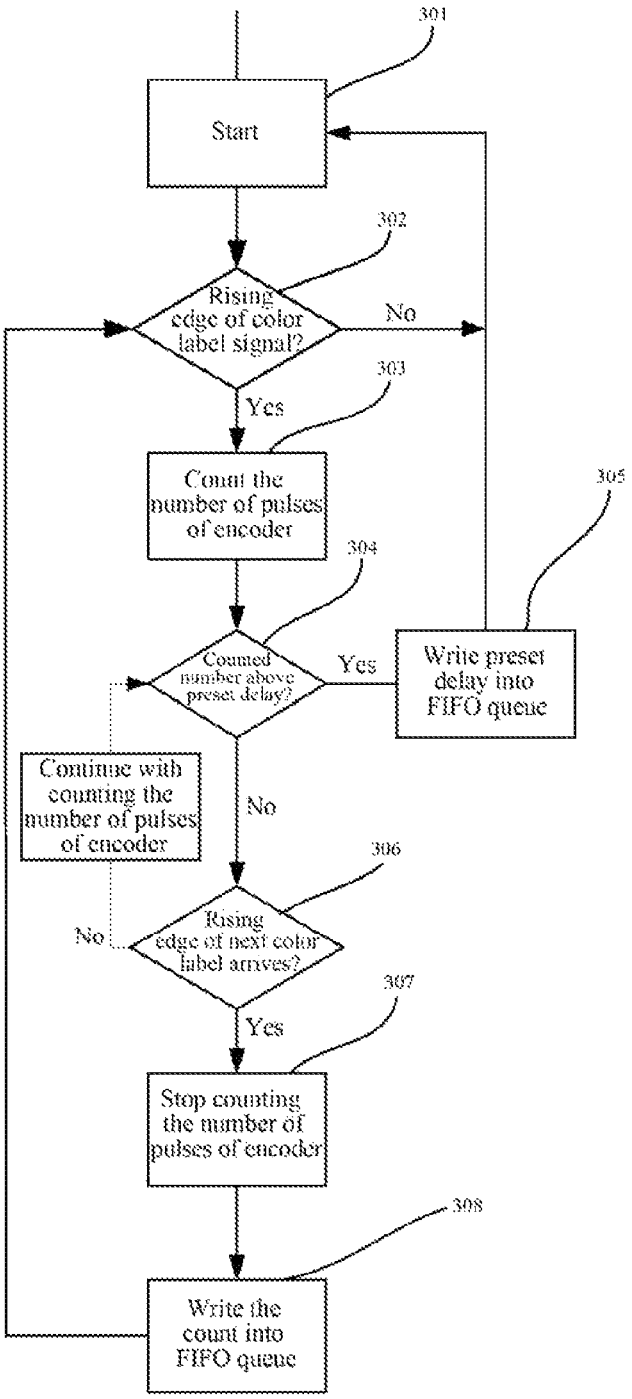
FIG. 3 illustrates a flow chart of a method for recording a separate distance or a delay distance.

Preferably, referring to FIG. 3, which is a flow chart of a method for recording the separation distance or the delay distance, the method includes the following steps.

S301 is to start.

S302 is to determine whether there is a rising edge of a color label signal, and if so, to proceed to S303; otherwise, to proceed to S301.

The occurring rising edge of the color label indicates detection of the color label.

S303 is to count the number of pulses of an encoder.

S304 is to determine weather the counted number is below a number of pulses corresponding to a preset delay distance, and if so, to proceed to S306; otherwise, to proceed to S305.

S305 is to write the number of pulses corresponding to the preset delay distance into a First Input First Output (FIFO) queue, and to turn to S301.

S306 is to determine whether another color label is detected, and if so, to proceed to S307; otherwise, to continue with counting the number of pulses of the encoder, and to turn to S304.

Figure 1:
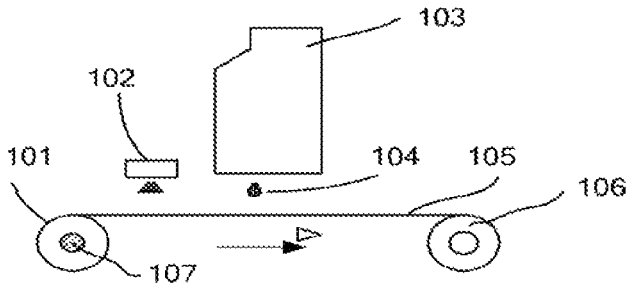
FIG. 1 illustrates a schematic diagram of an ink-jet printing device in operation.

A separation distance between the current color label detected in S306 and the preceding color label detected in S302 is determined upon detection of the current color label. Referring to FIG. 1, the encoder 107 is connected with the rotating shaft 101 of a mechanical platform for printing, so the encoder is driven by the rotating shaft of the mechanical platform to output pulse signals, and thus the separation distance can be determined from the pulse signals of the encoder.

Preferably the pulse signals can be filtered to remove interference signals.

Specifically timing is started upon arrival of a rising edge and a falling edge of a signal of the encoder, and also the level of the signal of the encoder at that time is recorded, and then there is another collection after 4 μs (which can be finely adjusted for the model of the encoder in use), and if the level of the signal of the encoder at this time is the same as the previously recorded level of the signal, then the current jump of the signal of the encoder is determined as an interference signal, and the signal of the encoder will be output without this jump, that is, with the interference signal filtered out; and if the level of the signal of the encoder at this time is different from the previously recorded level of the signal, then a valid jump of the signal of the encoder is determined, and the signal of the encoder will be output with this jump, thereby ensuring the obtained signal of the encoder to be a reliable signal.

S307 is to stop counting the number of pulses of the encoder.

The separation distance or the delay distance can be converted into the number of signal pulses of the encoder for use. As particular calculated, the distance (the separation distance or the delay distance) is S (in mm), the diameter of a wheel corresponding to the encoder is D (in mm), and the number of lines of the encoder is L, and then the distance can be converted into the number of pulses of the encoder, Count, in the formula of:

$$\text{Count} = \frac{S}{\pi * D / L}.$$

S308 is to write the counted number of pulses of the encoder into the FIFO queue and to turn to S302.

With the foregoing steps, the number of pulses of the encoder corresponding to the separation distance or the delay distance can be recorded into the FIFO queue, and preferably the identifier of the color label signal can be recorded in the FIFO queue correspondingly together with the number of pulses.

Figure 4:
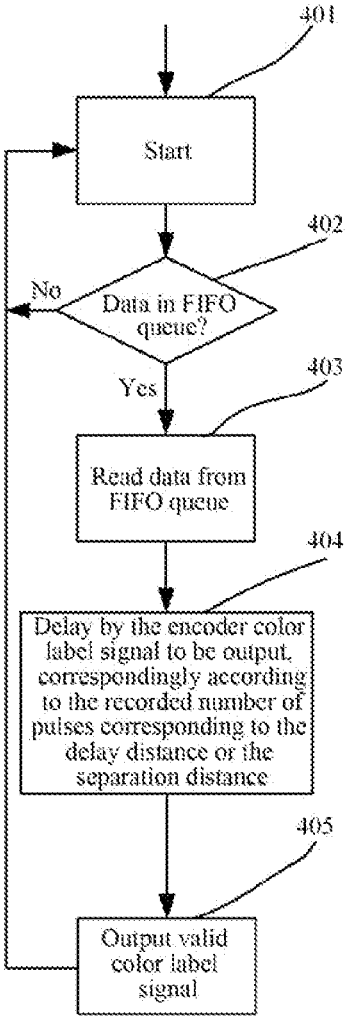
FIG. 4 illustrates a flow chart of a method for printing according to contents in an FIFO queue.

Preferably, referring to FIG. 4, which is a flow chart of a method for printing according to contents in the FIFO queue, the method includes the following steps.

S401 is to start.

S402 is to determine whether there is data in the FIFO queue, if so, to proceed to S403; otherwise, to proceed to S401.

S403 is to read the data from the FIFO queue.

S404 is to delay by the encoder the color label signal to be output, correspondingly according to the recorded number of pulses corresponding to the delay distance or the separation distance.

With the delay, the print carrier moves over the delay distance or the separation distance corresponding to the number of pulses and arrives below the jet head.

S405 is to output the valid color label signal and to turn to S401.

With the foregoing steps of reading from the FIFO queue, the detected color label signal can be recorded regardless of whether the device is waiting for the print carrier to move the delay distance, and the color label signals are in their original order as per the FIFO principle for convenient use in a subsequent step.

Figure 5:
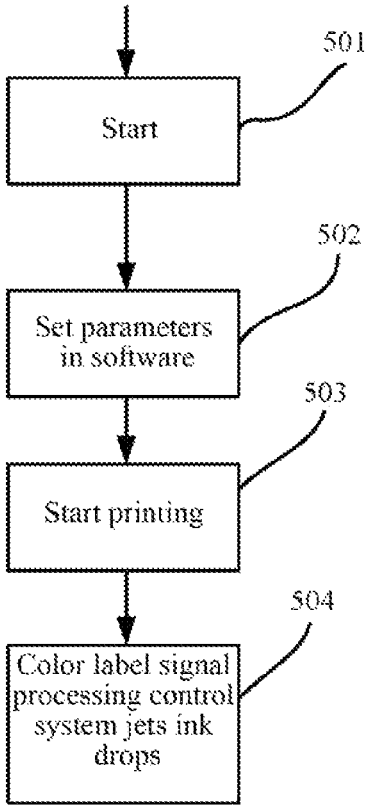
FIG. 5 illustrates a particular flow chart of the printing method.

Referring to FIG. 5, which is a particular flow chart of a printing method, the method includes the following steps.

S501 is to start.

S502 is to set parameters in software.

The delay distance, parameters of the encoder, etc., can be set.

S503 is to start printing.

S504 is to jet ink by a color label signal processing system.

After the color label signal is output in S405, the print carrier moves to below the jet head, and the color label signal processing system jets ink for imaging.

There may be a plurality of delay distances or separation distances in the FIFO queue, which can be processed one by one in their order in the FIFO queue. For example, there are a delay distance corresponding to a first color label and a separation distance corresponding to a second color label in the FIFO queue, and contents corresponding to the first color label are printed at the end of the delay distance corresponding to the first color label, and thereafter contents corresponding to the second color label are printed after traveling over the separate distance corresponding to the second color label.

Preferably the method for controlling ink-jet printing can further include:

In order to avoid to mistaken contents on the print carrier for a color label, the currently detected color label signal can be discarded as an interference signal if the separation distance is determined to be below a guard distance.

Figure 6:
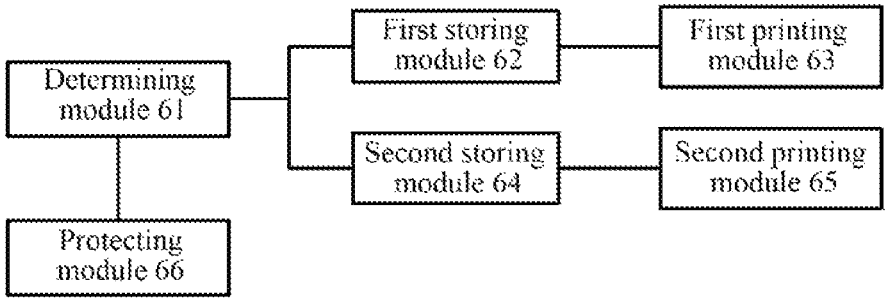
FIG. 6 illustrates a structural block diagram of an apparatus for controlling ink-jet printing.

An embodiment of the invention further provides an apparatus for controlling ink-jet printing, referring to FIG. 6, the apparatus includes:

- a determining module 61 configured to determine whether a separation distance between a current color label detected on a print carrier and a preceding color label of the current color label is a below a delay distance;
- a first storing module 62 configured to record the separation distance and trigger a first printing module 63 when a result of determination by the determining module 61 is being below the delay distance; and
- the first printing module 63 configured to print contents corresponding to the current color label when the print carrier moves over the separation distance recorded by the first storing module 62 starting from the end of printing contents corresponding to the preceding color label.

Preferably the apparatus further includes:

a second storing module 64 configured to record the delay distance and trigger a second printing module 65 when the result of determination by the determining module 61 is not being below the delay distance; and the second printing module 65 configured to print the contents corresponding to the current color label when the print carrier moves over the delay distance recorded by the second storing module 64 starting from the end of the printing contents corresponding to the preceding color label.

Preferably the apparatus further includes:

a protecting module 66 configured to discard the current color label as an interference signal when it is determined that the separation distance processed by the determining module 61 is below a guard distance.

Those skilled in the art shall appreciate that the embodiments of the invention can be embodied as a method, a system or a computer program product. Therefore the invention can be embodied in the form of an all-hardware embodiment, an all-software embodiment or an embodiment of software and hardware in combination. Furthermore the invention can be embodied in the form of a computer program product embodied in one or more computer useable storage mediums (including but not limited to a disk memory, a CD-ROM, an optical memory, etc.) in which computer useable program codes are contained.

The invention has been described in a flow chart and/or a block diagram of the method, the device (system) and the computer program product according to the embodiments of the invention. It shall be appreciated that respective flows and/or blocks in the flow chart and/or the block diagram and combinations of the flows and/or the blocks in the flow chart and/or the block diagram can be embodied in computer program instructions. These computer program instructions can be loaded onto a general-purpose computer, a specific-purpose computer, an embedded processor or a processor of another programmable data processing device to produce a machine so that the instructions executed on the computer or the processor of the other programmable data processing device create means for performing the functions specified in the flow(s) of the flow chart and/or the block(s) of the block diagram.

These computer program instructions can also be stored into a computer readable memory capable of directing the computer or the other programmable data processing device to operate in a specific manner so that the instructions stored in the computer readable memory create an article of manufacture including instruction means which perform the functions specified in the flow(s) of the flow chart and/or the block(s) of the block diagram.

These computer program instructions can also be loaded onto the computer or the other programmable data processing device so that a series of operational steps are performed on the computer or the other programmable data processing device to create a computer implemented process so that the instructions executed on the computer or the other programmable data processing device provide steps for performing the functions specified in the flow(s) of the flow chart and/or the block(s) of the block diagram.

Although the preferred embodiments of the invention have been described, those skilled in the art benefiting from the underlying inventive concept can make additional modifications and variations to these embodiments. Therefore the appended claims are intended to be construed as encompassing the preferred embodiments and all the modifications and variations coming into the scope of the invention.

Evidently those skilled in the art can make various modifications and variations to the invention without departing from the scope of the invention. Thus the invention is also intended to encompass these modifications and variations thereto so long as the modifications and variations come into the scope of the claims appended to the invention and their equivalents.

The invention claimed is:

1. A method for controlling ink-jet printing, comprising:

determining whether a separation distance between a current color label detected on a print carrier and a preceding color label of the current color label is below a delay distance;

recording the separation distance if it is below the delay distance, and triggering to print, with a first print module, contents corresponding to the current color label when the print carrier moves over the separation distance starting from the end of printing contents corresponding to the preceding color label;

recording the delay distance if the separation distance is not below the delay distance, and triggering to print, with a second print module, the contents corresponding to the current color label when the print carrier moves over the delay distance starting from the end of the printing contents corresponding to the preceding color label.

2. The method according to claim 1, wherein the separation distance or the delay distance is recorded in the form of a First Input First Output, FIFO, queue.

3. The method according to claim 1, further comprising:

recording an identifier of the current color label correspondingly together with the delay distance or the separation distance.

4. The method according to claim 1, further comprising:

discarding the current color label as an interference signal upon determining that the separation distance is below a guard distance.

5. The method according to claim 1, wherein the separation distance or the delay distance over which the print carrier moves is determined by the number of signals of an encoder.

6. An apparatus for controlling ink-jet printing, comprising:

a determining module configured to determine whether a separation distance between a current color label detected on a print carrier and a preceding color label of the current color label is below a delay distance;

a first storing module configured to record the separation distance and trigger a first printing module when a result of determination by the determining module is being below the delay distance; and the first printing module configured to print contents corresponding to the current color label when the print carrier moves over the separation distance starting from the end of printing contents corresponding to the preceding color label;

a second storing module configured to record the delay distance and trigger a second printing module when the result of determination by the determining module is not being below the delay distance; and the second printing module configured to print the contents corresponding to the current color label when the print carrier moves over the delay distance starting from the end of the printing contents corresponding to the preceding color label.

7. The apparatus according to claim 6, further comprising:

a protecting module configured to discard the current color label as an interference signal when it is determined that the separation distance is below a guard distance.

* * * * *